United States Patent [19]

Platt

[11] 4,208,896

[45] Jun. 24, 1980

[54] WIRE COILING APPARATUS

[75] Inventor: Stephen A. Platt, Grand Haven, Mich.

[73] Assignee: S. A. Platt, Inc., Grand Haven, Mich.

[21] Appl. No.: 7,158

[22] Filed: Jan. 29, 1979

[51] Int. Cl.[2] ..... B21F 3/04

[52] U.S. Cl. ..... 72/142; 72/145

[58] Field of Search ..... 72/49, 66, 135, 140, 72/142, 145, 465, 466

[56] References Cited

U.S. PATENT DOCUMENTS

| | | | |
|---|---|---|---|
| 2,227,602 | 1/1941 | Platt | 72/145 X |
| 2,868,267 | 1/1959 | Platt | 72/145 |
| 2,909,209 | 10/1959 | Ciccone et al. | 72/145 X |
| 3,082,810 | 3/1963 | Platt | 72/145 |
| 3,359,768 | 12/1967 | Platt | 72/135 X |
| 3,401,557 | 9/1968 | Platt | 72/145 |
| 3,444,716 | 5/1969 | Martin | 72/135 |

FOREIGN PATENT DOCUMENTS

| | | | |
|---|---|---|---|
| 478678 | 2/1953 | Italy | 72/466 |
| 514247 | 11/1939 | United Kingdom | 72/142 |

*Primary Examiner*—Ervin M. Combs

*Attorney, Agent, or Firm*—Price, Heneveld, Huizenga & Cooper

[57] ABSTRACT

A wire coiling apparatus employing a pair of coiling rolls with rigid, usually steel, backup and drive ring members in direct driven engagement with the mandrel spindle, coupled to work rings which have controlled resilient transverse floating action under coil forming pressures, to rotate off center relative to the drive rings which drive them. In one embodiment, each work ring has a steel forming surface which is part of a metal outer ring member mounted on a resilient inner ring member. In another embodiment, each work ring is a resilient member which has a resilient forming surface.

14 Claims, 6 Drawing Figures

WIRE COILING APPARATUS

BACKGROUND OF THE INVENTION

This invention relates to wire coiling apparatus for high speed coiling of wire at uniform coiling pressures.

The formation of wire coils on a spinning mandrel (which those in the trade sometimes call an arbor) has been practiced for many years. A few decades ago, this was largely accomplished by the use of a pair of rubber coiling rolls astraddle the mandrel, as set forth for example in my U.S. Pat. No. 2,227,602 (1941). The rubber rolls were driven directly by the mandrel spindle, thereby being in synchronization with the mandrel. Subsequent demands for greatly increased production output from the coiling machines necessitated application of a liquid cooling medium or solution in the zone of the forming coil to dissipate the heat generated. But, such liquid solutions seriously disrupted the frictional grip of the rubber forming rolls on the spindle. Thus, rubber rolls could not be effectively used for many coiling operations. The heat generated as the metal was worked limited the production speed so that the first few turns being formed on the mandrel did not melt the rubber forming surfaces. Rolls of rubber or other resilient compositions also exhibited another fault in that the carefully balanced coiling forces became upset by problems in the infeeding wire, e.g. bends, snarls, and kinks. The wire would wind back on the resilient backup shoulder, causing the wire to "ball up", so to speak, on the mandrel and "chew up" the carefully and accurately ground surfaces of the coiling rolls before the operator could shut the machine off. Unwatched ends of the wire from the pay off spool could produce similar results. In each case, the rolls had to be removed and reground before coiling could resume, thereby causing undesirable down time.

Thereafter, steel coiling rolls driven by flexible drive shafts such as taught in my subsequent U.S. Pat. Nos. 2,868,267, 3,082,810, and 3,401,557, assumed an important position. Cooling solutions could be applied to the coil forming zone without affecting the drive relationship of the coiling rolls. Steel forming surfaces moreover are not readily damaged. Production speeds could therefore be increased. These were used for medium and heavy wire since considerable power could be picked up at the rear of the machine and fed forward via flexible cables and speed reducers to the coiling rolls. But because these rolls of necessity are mounted in hangers, the drive force to one roll, usually the one slightly to the rear, had its drive torque added to the pressure of that roll on the coil being formed, while the drive force to the other roll had its drive torque subtracted from the pressure of this other roll. The resulting unequal pressures can be tolerated while coiling medium to heavy wire, but not on fine wire.

Another approach which was tried is set forth in U.S. Pat. No. 2,909,209 in which a front roll of elastic material was applied to my flexible cable driven machine in a version called a one-sided coiler. Using a one-sided coiler, the wire, typically medium gage (by today's standards) will expand instantly from its grip on the mandrel. Here also, cooling solution was used. However, the unit was a failure unless the coil was stiff enough to retain its true helix with one opposite shoulder backup. It lacked a positive solid shoulder for the first turn of wire on the resilient roll side to prevent wind back. The machine therefore was discontinued.

But, as technological developments have continued in the products for which the wire coils are formed, not only are higher production rates demanded, but also the wire sizes to be coiled covered a broad range from extremely fine diameters, e.g. about the size of human hair to considerably larger diameters. Yet the coils formed have to be uniform in characteristics such as electrical resistivity, pitch, strength and the like. Steel coiling rolls have difficulty coiling fine wire in a manner to meet these high demands. Complete synchronism of the drive shaft-driven steel rolls with the arbor is extremely difficult to achieve, and almost impossible to maintain. The steel rolls moreover do not apply uniform forming pressure required to obtain a uniform coil of fine wire as noted above. The rolls are not sufficiently sensitive to the wire characteristics. I have determined that fine wires, of themselves, cannot form a uniform helix on a mandrel without the first turn of wire having positive unyielding, i.e. inelastic, shoulder support for the front and rear portions of this turn, i.e. from both forming rolls. And the pressure must be uniform. Moreover, the work rolls must be fully synchronized with the mandrel and each other. And they must be sensitive to the wire characteristics. Therefore, there has been a definite need for a wire coiling apparatus not heretofore available.

SUMMARY OF THE INVENTION

An object of this invention therefore is to provide a wire coiling apparatus capable of uniform coiling of wire, even extremely fine hair-size wire, at high production output rates, using coiling rolls having inelastic backup shoulders as of steel, for both sides of the first turn of wire, capable of application of cooling liquid at the forming zone, having a delicate sensitive responsiveness to wire characteristics, achieving uniform balanced pressure from both coiling rolls on the coiling wire at the mandrel, and with the coiling rolls driven in complete synchronism with the arbor and each other.

The novel coiling apparatus employs a pair of unique work rolls, each having two main components or members coupled together. That is, a pair of direct spindle driven rigid, such as steel, drive rolls forming inelastic backup shoulders, are coupled with work rolls having a special transverse floating capacity to rotate, while under coil forming pressure, off center relative to the drive rolls to which they are coupled. The drive sequence is from the spindle directly to the rigid backup drive rolls in peripheral engagement therewith, and from the drive rolls to the work rolls coupled thereto. The work ring members have resilient floating action transversely of the axis of rotation as a result of resilient deformation of an inner cushion ring member, in one form which has a steel outer forming ring member too, or of the entire resilient work ring in another form of apparatus. The transversely floating work rings expose steel backup shoulders on the adjacent drive and backup rings. An aspect of this invention comprises the discovery that this combination can employ rigid steel drive rings driven by direct metal-to-metal, specifically steel-to-steel, driving contact of the pair of drive rings against opposite sides of the spinning mandrel or spindle. These and other objects and advantages as well as the details of construction of the preferred embodiments will be apparent from a view of the following detailed specification in conjunction with the drawings.

DESCRIPTION OF THE PREFERRED EMBODIMENT

Figure 1:
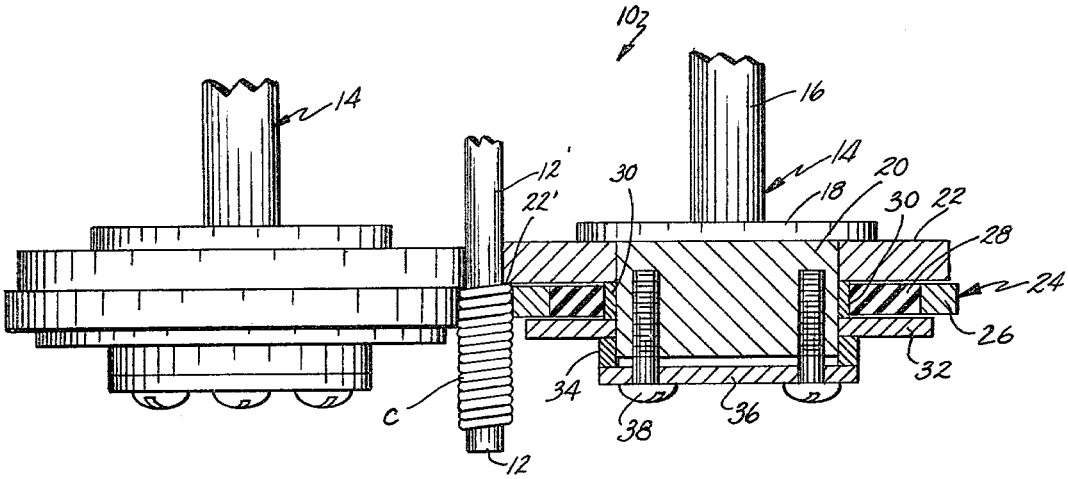
FIG. 1 is a fragmentary plan view of the first embodiment of the coiling combination.
Figure 2:
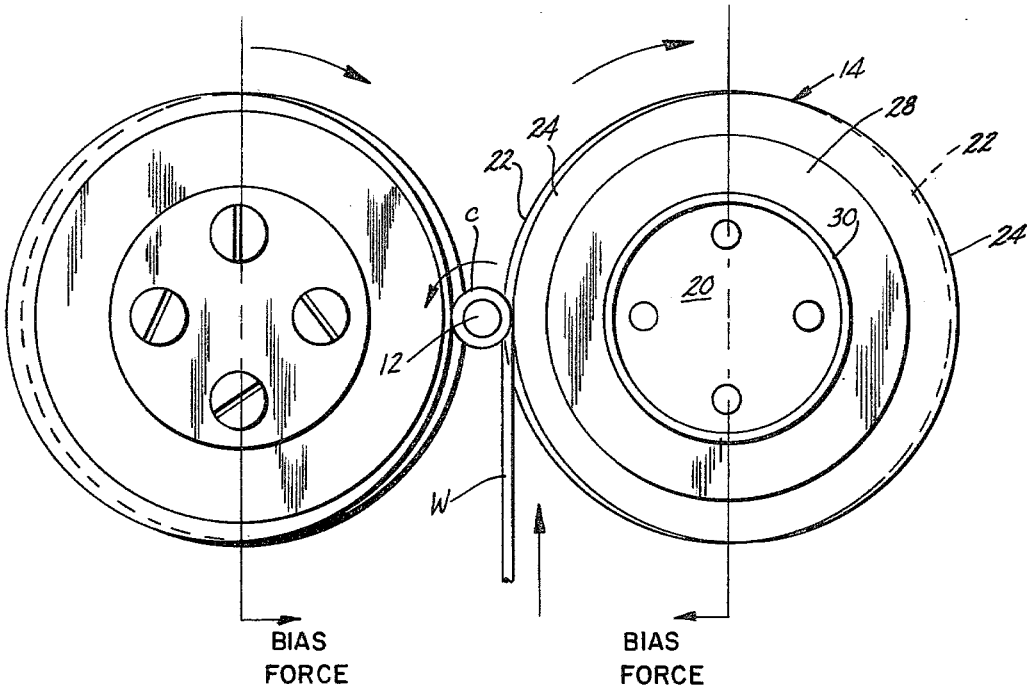
FIG. 2 is an end elevational view of the first embodiment in FIG. 1.

Referring now specifically to FIGS. 1 and 2 of the drawings, the embodiment of the coiling machine 10 there depicted includes a cylindrical mandrel or arbor 12 on the end of and being an integral portion of a rotationally mounted and rotationally driven spindle 12'. The spindle is mounted in conventional bearings and rotationally driven by a conventional motor, usually electric. The wire W (shown with exaggerated diameter) is formed into a coil C about the mandrel 12 and feeds off the free end thereof. Astraddle this mandrel is a pair of cooperative, like, coil forming subassemblies 14 suspended on a pair of typical roll hangers such as those described below relative to the third embodiment in FIGS. 5 and 6. These subassemblies are on opposite sides of spindle 12', being slightly axially offset relative to each other in an amount equal to the pitch of the coil being formed to thereby serve as back and front coiling rolls. For convenience, the coiling subassembly on the right in FIG. 1 is shown sectioned.

Each subassembly includes a rotationally mounted support shaft 16 suspended in a bearing of the hanger. On the end of each shaft is affixed a hub formed of a circular back plate 18 and a cylindrical rim 20. Mounted on rim 20 and abutting against plate 18 is a rigid, usually metal and preferably steel drive ring or disc 22 which has a cylindrical periphery in direct engagement with the polished cylindrical periphery of the mandrel spindle, to be directly driven thereby. Each such ring or disc serves not only for driving, in the manner to be explained hereinafter, but also forms a rigid, inelastic, axial backup shoulder adjacent its periphery for the first turn of wire coil being formed, as explained hereinafter. The two annular shoulders of the two drive rings support both sides of the coil against back flow. Positioned flush against the outer axial face of this ring 22, i.e. on the opposite side as plate 18, and coupled thereto is work ring combination 24. In this embodiment, it includes a radially outer, metal, usually steel, coiling ring member 26 mounted on, preferably bonded to, and in drive engagement at its inner periphery with, the outer periphery of a radially inner, resilient, preferably rubber cushion ring member 28. The rubber has a durometer hardness of 40 to 80, preferably 60–80. In this embodiment, if the rings are not bonded or otherwise adhered together, they should at least be in tight frictional relationship because the drive is through the resilient member. Member 28 is of a resilient polymeric material such as rubber or the equivalent, capable of being temporarily transversely deformed, relative to its rotation axis, under forming pressure, so as to rotate off center relative to the drive ring in a floating type movement. At the inner peripheral face of member 28 is a spacer sleeve ring 30 around the periphery of rim 20, preferably bonded or otherwise adhered to member 28, and at least in frictional drive relation thereto, to cause plate 22 to drive sleeve 30 and thus cushion ring 28 and outer ring 26. The axial width of spacer sleeve 30 is slightly greater than the axial width of outer steel ring member 26, and of the resilient cushion ring 28, e.g. about two thousandths of an inch, to facilitate the floating action. Sitting flush against the axially outer end face of spacer sleeve 30 is an annular retainer plate 32. Abutted against the outer face of this retainer 32 is a second spacer sleeve 34 positioned on rim 20. A clamping plate 36 abuts the outer axial face of spacer sleeve 34. A plurality of fasteners such as screws 38 or bolts extend through openings in clamping plate 36 into threaded engagement with rim 20. This clamps spacer 34, retainer 32, spacer 30 and ring 22 tightly against back plate 18 to hold these in fixed relationship relative to each other for rotational drive. When so clamped, a slight clearance (shown exaggerated in FIG. 1) exists between the axial faces of ring 26 and retainer 32 on one side and ring 22 on the other side, as shown in exaggerated form in FIG. 1, to allow ring 26 to have a limited controlled floating motion in a radial direction relative to its axis of rotation, i.e. transversely to the axis of rotation, against the inherent return bias of cushion ring 28. This floating action, against the inherent bias of the resilient polymer, causes the forming surface to rotate off center relative to the drive ring, and exposes an axially facing, backup shoulder adjacent the periphery of each drive roll.

In FIG. 2, the subassembly 14 in the right side of the drawing is shown with certain components removed for clarity, namely fasteners 38, clamping plate 36, spacer 34, and retainer 32.

Figure 5:
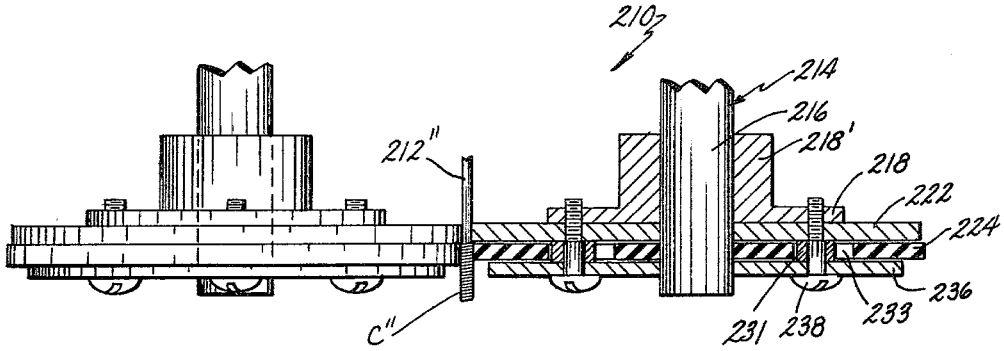
FIG. 5 is a fragmentary plan view of a third embodiment coiling combination.
Figure 6:
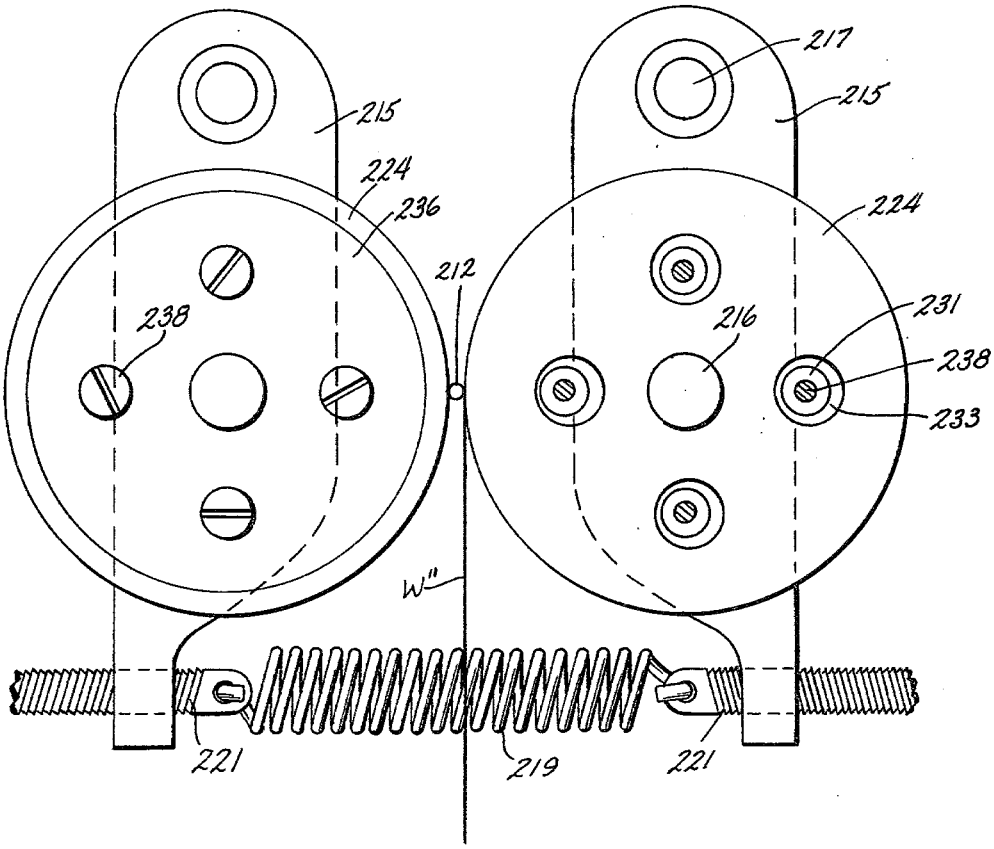
FIG. 6 is an end elevational view of the third embodiment in FIG. 5.

In FIGS. 1 and 2, the subassemblies 14 are shown with a transverse offset (exaggerated) of forming ring members 26 relative to backup drive discs 22, the portions of resilient cushion ring members 28 closest to the arbor being compression deformed against their inherent bias and the portions on the opposite side being extension deformed. The deformation occurs when the subassemblies are pressed into coiling engagement such that the drive rings 22 engage the arbor spindle and the coiling or work rings 26 engage the wire coil being formed. These subassemblies are pressed toward each other and the mandrel, in forming position by suitable biasing forces (indicated on FIG. 2) caused by a tension coil spring between the roller hangers, as shown in FIGS. 5 and 6 for the third embodiment.

During operation of the apparatus, rotational power is applied to spindle 12' and its mandrel 12 by a conventional motor. The frictional engagement of drive rings 22 with this spindle causes subassemblies 14 to rotate in the directions indicated by the arcuate arrows in FIG. 2, simultaneously with infeeding of wire W to form coil C around mandrel 12. Drive discs or rings 22 cause respective spacer sleeve rings 30 to rotate therewith, thereby rotating resilient cushion ring members 28, to in turn cause metal work ring members 26 to rotate therewith. These members thus all rotate in complete synchronism with the mandrel. The end of wire W is fed into the corner between the outer peripheral forming surface of ring 26 and the adjacent transverse, i.e. axially oriented, inelastic backup shoulder 22 adjacent the outer periphery of disc or ring 22. The outer peripheral surface of ring 26 in each subassembly 14 is initially slightly closer to the arbor periphery than the thickness of wire W, with the cushion being undeformed, but is shifted radially outwardly by the entering wire, against the bias of the deforming cushion ring member 28, to be at a spacing from the arbor equal to the wire thickness. As the components rotate, compression of progressive portions of cushion ring members 28 occur adjacent the mandrel, with a resulting floating action of work ring member 26 transversely to its axis of rotation. The formed coil advances progressively axially along the mandrel and off the free end thereof.

Figure 3:
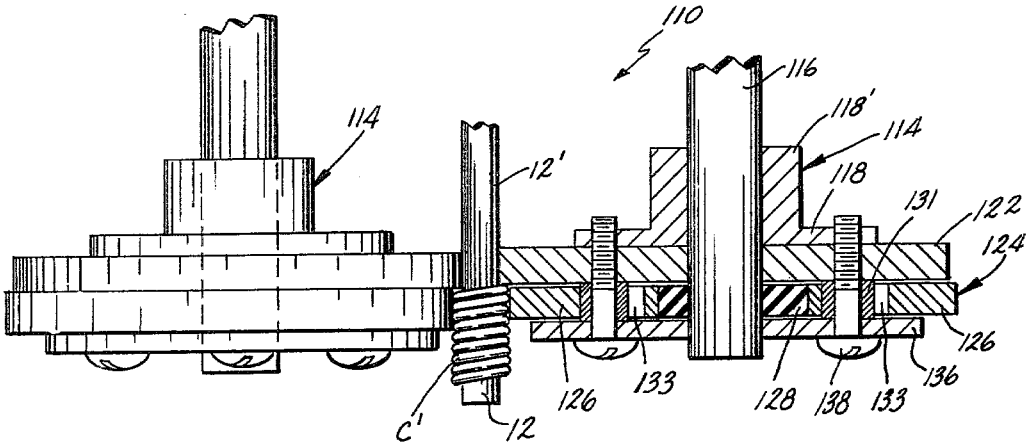
FIG. 3 is a plan fragmentary view of a second embodiment of the coiling combination which is a variation of the first embodiment.
Figure 4:
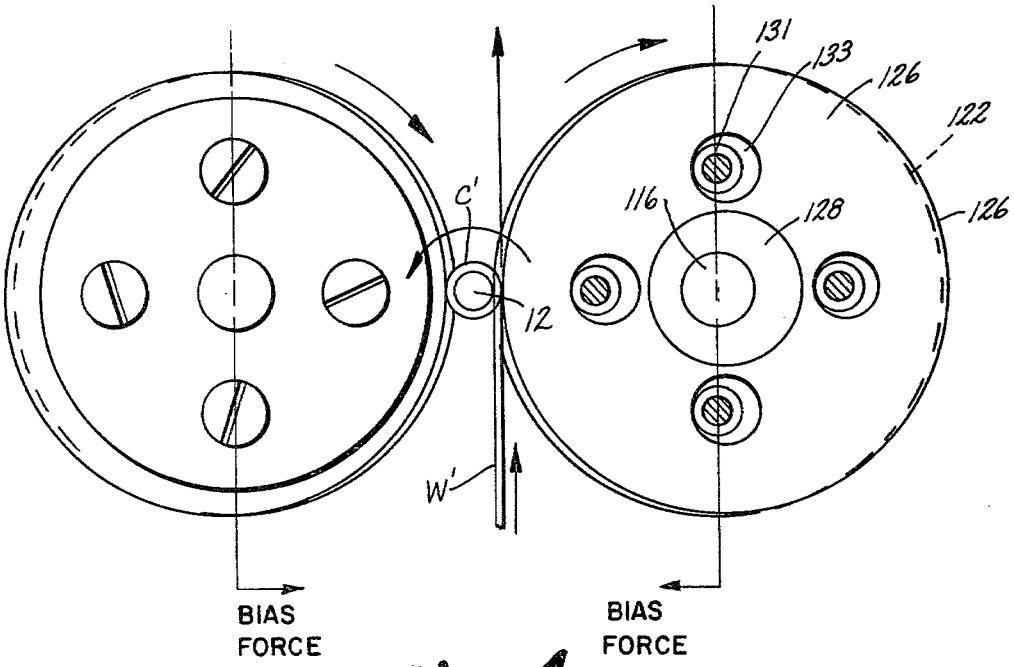
FIG. 4 is an end elevational view of the second embodiment in FIG. 3.

If finer wire sizes are to be coiled, the coiling subassemblies are preferably provided with smaller diameter resilient cushion ring members are depicted in the modified embodiment in FIGS. 3 and 4, and, optionally, a somewhat lower durometer hardness of the cushion insert.

Referring now to the embodiment depicted in FIGS. 3 and 4, the coiling assembly 110 again employs a conventional mandrel 12 and spindle 12' in combination with a pair of modified coiling subassemblies 114 astraddle thereof, these being identical with each other except that one is slightly offset axially to the other equal to the pitch of the coil being formed. For clarity, the subassembly shown on the right side of FIG. 3 is sectioned, while the subassembly on the right side of FIG. 4 is shown with certain components removed. As in the first embodiment, subassemblies 114 are mounted on conventional roll hangers of the type in FIGS. 5 and 6, to be biased equal amounts toward the mandrel and toward each other with a tension spring therebetween of the type noted in FIGS. 5 and 6.

As with the first embodiment, the transverse offset of the floating forming ring members 126 is shown exaggerated, as is the diameter of wire W' being formed into coil C', and the spacing or clearance at the axial faces of forming or work ring 126. As in the previous embodiment, there is a pair of rotationally mounted shafts 116, but in this embodiment each shaft extends through plate 118 to form the rim on which the other members are mounted. Since the diameter of the shaft is smaller than that of the rim 120 of the first embodiment, a smaller diameter rubber cushion ring can be employed. Sleeve 118' keyed to shaft 116 extends from plate 118 to cause the shaft to rotate therewith. Backup or drive ring 122 is positioned flush against the outer axial face of plate 118. The coiling or work ring 124 includes a radially outer steel ring member 126 mounted with its inner periphery secured to the outer periphery of radially inner resilient cushion ring member 128, to which it is preferably bonded or otherwise adhered and at least in frictional drive relation thereto. The clamping plate 136 is secured to drive plate 122, with these two plates being axially astraddle of work ring 124. This securement is with a plurality of stud fasteners such as screws 138 or bolts which extend through these components and into threaded engagement with back mounting plate 118. Around each of fasteners 138 within enlarged openings 133 is an annular spacer sleeve 131. Since the fasteners 138 and sleeves 131 pass through the steel work ring 126, accommodation for the transverse floating action of the steel ring, with biased deformation of the annular resilient cushion ring 128, is achieved with enlarged openings 133 in steel ring member 126. Openings 133 are considerably larger in diameter than the outer diameter of spacers 131 for this purpose. Spacer sleeves 133 also have an axial width slightly greater than the axial width of steel ring 126 and the axial width of resilient cushion ring 128. This allows the assembly to be clamped together to rotate as a unit, with clearance (shown exaggerated) on opposite faces of work ring member 126 for transverse floating movement thereof. As will be explained, the drive from the drive plates 112 is direct to the work rings 126 rather than through the cushion members as in the first embodiment.

In operation of this second embodiment depicted in FIGS. 3 and 4, wire W' is fed to the spinning mandrel 12 at the corner between the axially facing rigid, metal backup shoulder adjacent the outer periphery of ring 122 and the peripheral metal forming surface of rotating ring member 126. That is, subassemblies 114 are rotationally driven in the direction indicated by the arrows in FIG. 4 by frictional engagement of rings 122 with the periphery of spindle 12' in synchronism with the mandrel. Rings 122 drive studs 138 and spacer sleeves 131. These engage a portion of the walls of openings 133 to thereby drive work ring 126. It in turn drives cushion ring 128. The coiling surfaces on the outer peripheries of the steel ring members 126 are continuously offset during coiling by the interjection of the wire between the mandrel and the coiling surfaces, causing temporary deformation of the cushion rings 128 against inherent bias, with compression thereof at the portions closest the arbor and extension thereof at the portions opposite.

In FIGS. 5 and 6, the third embodiment of the coiling machine combination is depicted, such having been found to be particularly suited for coiling extremely fine wire. More specifically, the coiling assembly 210 has as its central component a conventional but small mandrel 212 integral with its spindle 212' on which wire W" is formed into a coil C" in combination with a pair of forming roll subassemblies 214. These roll subassemblies are alike, one being axially forward of the other the thickness of the wire, with the forming roll on the right in FIG. 5 shown in section and in FIG. 6 shown with certain components removed, for clarity. These forming rolls are mounted on conventional hangers 215 which have upper pivot pins 217, the shafts 216 of the forming rolls being rotationally mounted on the hangers intermediate the ends of the hangers. Connected to the lower ends of hangers 215 opposite the ends with pivot pins 217 is a tension coil spring 219 attached to the hangers by suitable threaded fasteners 221. This applies a balanced pressure by the two forming rolls against the mandrel and spindle and the wire being formed into a coil on the mandrel. As in the second embodiment, each shaft 216 forms a hub extending through sleeve 218' and its integral plate 218. Flush against plate 218 is the backup drive ring or disc 222 secured to the plate 218 and shaft 216 to rotate therewith. At the opposite axial face of backup drive plate 222 from the plate 218 is a separate work ring 224 rotationally coupled to the drive plate 222. At the opposite face of work ring 224 is a clamping plate 236. Work ring 224 comprises a resilient polymeric disc or ring as of rubber of durometer range indicated previously herein, and in this embodiment the outer peripheral forming surface is of this resilient material also. But importantly, the backup shoulder for the coil is of rigid, normally steel, inelastic material of the drive disc during the operation described hereinafter. The drive coupling connection between work ring 224 and drive ring 222 employs a plurality of fasteners 238 extending through clamping plate 236, work ring 224, drive ring 222, and plate 218. Around fasteners 238 where they extend though work ring 224 are spacer sleeves 231 received within enlarged openings 233 in work ring 224. The openings are substantially larger in diameter than the diameter of spacer sleeves 231 as in the second embodiment described above. The width of the spacers is larger, as by two or three thousandths of an inch or so, than the width of work ring 224 to facilitate the transverse floating capacity of the work ring during operation, under pressure of engagement of the work ring peripheries with opposite sides of the forming coil, such that the work rings rotate off center relative to the drive rings 222 and the axes thereof.

During operation of the third embodiment of the apparatus, therefore, as the spindle and mandrel are rotationally driven by a motor (not shown), coil spring 219 applies equal pressure by the drive rings 222 against the periphery of spindle 212' to cause synchronous direct drive from the spindle to the forming roll subassemblies. The drive power from the drive rings is transferred to the work rings coupled thereto. The periphery of the work rings is pressed against the wire being formed into a coil on the spindle, the pressure being equal under the balancing action of spring 219 and the direct drive from the spindle. This pressure causes the outer peripheral portion of work rings 224 in immediate engagement with the coil to be forced outwardly, causing a deformation of the work rings, the portions between the spindle and the shafts 216 being compression deformed and the portions on the opposite side of the shaft being extension deformed, such that the extension deformed portions protrude beyond the drive ring as depicted in exaggerated form in FIG. 5. Consequently, during the high speed rotation of the forming roll subassemblies, the work rings transversely float to in effect operate off center relative to the drive rings, and the axes of rotation, the shift being facilitated by the spacing 233 provided around the sleeves 231 and the slight axial clearance. The offset of the work roll exposes a rigid backup shoulder at each side of the spindle, i.e. of adjacent portions of the drive and backup discs 222, to prevent the forming coil from back flow.

In applying this inventive concept to particular coiling uses, it is entirely conceivable that other variations in the structural details may be employed. The preferred embodiments depicted are considered illustrative of the invention which is defined in the following claims.

The embodiments of the invention in which an exclusive property or privilege is claimed are defined as follows:

1. A wire coiling apparatus comprising:

a pair of coiling rolls astraddle a rotational mandrel and spindle therefor and having rotational axes; each said coiling roll comprising (a) a rigid drive disc with a spindle engaging periphery for direct driving of both drive discs by said spindle, and (b) a work ring operably coupled to said rigid drive disc and resiliently transversely floatable relative to said rotational axis, under coil forming pressure, and including a coil forming peripheral surface; means biasing said coiling rolls toward said mandrel and spindle for pressing said drive discs into engagement with said spindle and pressing said work rings into engagement with opposite sides of a wire coil being formed on said mandrel, causing resilient transverse deformation of said work rings relative to the rotational axis thereof in a transverse floating action, said deformation exposing axially facing, rigid backup shoulders of said drive discs at said mandrel to axially retain the forming coil against back flow.

2. The wire coiling apparatus in claim 1 wherein said work rings have slight clearance from said drive discs to facilitate said floating action.

3. The wire coiling apparatus in claim 1 wherein said work rings each comprise a resilient radially inner cushion member and a rigid, radially outer, coiling ring member thereon.

4. The wire coiling apparatus in claim 1 wherein said drive discs are steel.

5. The wire coiling apparatus in claim 1 wherein said work rolls are mounted on pivotal hangers and means for biasing said coiling rolls is a coil spring between said hangers.

6. Wire coiling apparatus comprising:

a rotationally driven spindle having a mandrel with a peripheral surface around which a wire coil is formed; a pair of rotational rigid drive discs astraddle said spindle and having peripheral drive surfaces in engagement with said spindle to cause said drive discs to be rotationally driven by said spindle; a pair of work rings astraddle said mandrel, each work ring having a metal, radially outer coiling ring member mounted on a resilient inner cushion ring member to rotate therewith; said work rings being coupled in driven relation with said drive discs; and said outer ring member when pressed against coiling wire on said mandrel, having resilient radial floating movement capacity transverse to the rotational axis thereof by resilient deformation of said inner cushion ring member to be offset for application of uniform pressure by said work ring members to the coil being formed and exposure of rigid backup shoulders on said drive discs.

7. The wire coiling apparatus in claim 6 wherein said resilient inner cushion rings are in coupled driven relationship with said drive discs and are in driving relationship to said outer coiling ring members.

8. The wire coiling apparatus in claim 6 including an inner annular spacer sleeve member radially within said cushion ring member, retained to said drive disc to be driven thereby and itself in driving relation to said cushion ring member.

9. Wire coiling apparatus comprising:

a central spindle and mandrel;

a set of work rings astraddle said mandrel, on rotational axes; rotational drive connection means to said work rings for rotationally driving said work rings comprising a drive disc coupled to each work ring, each said driving disc being in drive engagement with said spindle to be driven thereby, and with said work ring;

each said work ring having a resiliently deformable mounting member, and coiling ring member with a metal, peripheral, coil forming surface; said outer coiling ring member being mounted on said resiliently deformable mounting member, and being floatingly shiftable transversely of said rotational axis of said work ring against the inherent bias of said resiliently deformable mounting member, said driving disc forming a rigid backup shoulder adjacent said work ring forming surface to retain the forming coil against back flow.

10. The wire coiling apparatus in claim 9 wherein said resiliently deformable mounting member is of a resilient polymeric material radially inwardly of said coiling ring member, said resilient mounting ring members and said outer coiling ring members being spaced slightly from said drive discs to facilitate said floating action.

11. The wire coiling apparatus in either claim 9 or 10 wherein said work rings are steel.

12. A wire coiling apparatus comprising:

a pair of coiling rolls astraddle a rotational mandrel and spindle therefor and having rotational axes; each said coiling roll comprising (a) a rigid drive disc with a spindle engaging periphery for direct driving of both drive discs by said spindle, and (b) a work ring of resilient material operably coupled to said rigid drive disc and resiliently transversely floatable relative to said rotational axis, under coil forming pressure, and including a coil forming peripheral surface; means biasing said coiling rolls toward said mandrel and spindle for pressing said drive discs into engagement with said spindle and pressing said resilient work rings into engagement with opposite sides of a wire coil being formed on said mandrel, causing resilient transverse deformation of said work rings relative to the rotational axis thereof in a transverse floating action, said deformation exposing axially facing, rigid backup shoulders of said drive discs at said mandrel to axially retain the forming coil against back flow.

13. The wire coiling apparatus in claim 12 wherein said work rings have slight clearance from said drive discs to facilitate said floating action.

14. The wire coiling apparatus in claim 12 wherein said drive discs are steel.

* * * * *